US005778582A

United States Patent [19]

Rath

[11] Patent Number: 5,778,582

[45] Date of Patent: Jul. 14, 1998

[54] SIGN DEVICE

[75] Inventor: Klaus Peter Rath, Vejle, Denmark

[73] Assignee: A/S MODULEX, Billhund, Denmark

[21] Appl. No.: 626,714

[22] Filed: Mar. 29, 1996

[30] Foreign Application Priority Data

Mar. 31, 1995 [DK] Denmark ..... 0354/95

[51] Int. Cl.[6] ..... G09F 1/12

[52] U.S. Cl. ..... 40/611; 403/330; 40/781

[58] Field of Search ..... 40/781, 611; 403/330

[56] References Cited

U.S. PATENT DOCUMENTS 4,656,764 4/1987 Fengler ..... 40/781 X
4,779,366 10/1988 Jost ..... 40/781 X
5,012,601 5/1991 Garland et al. ..... 40/781
5,081,777 1/1992 Kim ..... 40/781
5,235,767 8/1993 Waterman et al. ..... 40/781 X
5,570,968 11/1996 Sassmannshausen et al. ..... 403/330 X

*Primary Examiner*—Brian K. Green
*Assistant Examiner*—Andrea Chop
*Attorney, Agent, or Firm*—Kane Dalsimer, Sullivan, Kurucz, Levy, Eisele and Richard, LLP

[57] ABSTRACT

A sign device having a rear plate and a front plate. The rear plate has a first connecting part, and the front plate has a second connecting part. The connecting parts are engageable to connect the rear and front plates. One of the two connecting parts is provided on one end of a rocker member having a partially elastic area at the other end. The two connecting members may be disengaged by acting on the elastic area. The connecting parts may also serve as hinges.

10 Claims, 3 Drawing Sheets

SIGN DEVICE

Figure 1:
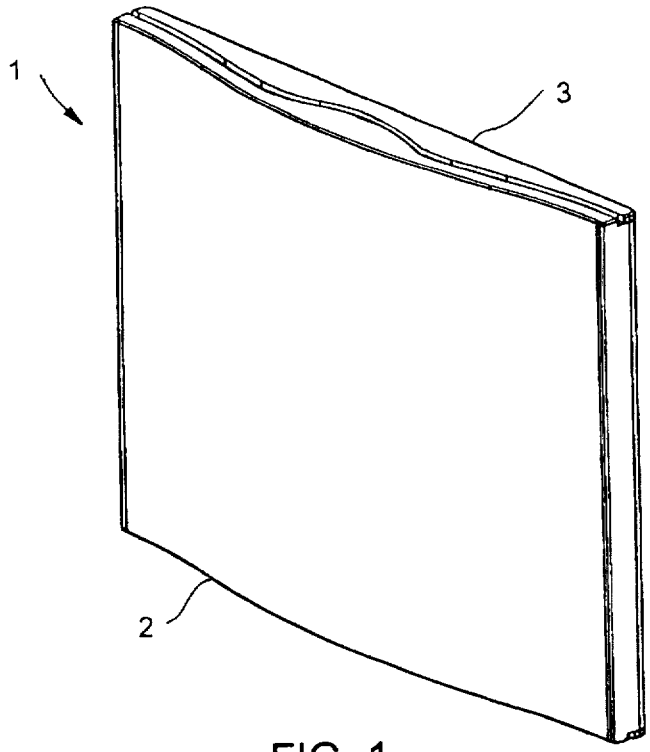

The invention concerns a sign device of the type which comprises a rear plate and a front plate. The front plate is connected with the rear plate by connecting means which have a first connecting part on the rear plate in engagement with a second connecting part on the front plate.

Numerous signs of this type are known, which may e.g. be used as name signs at the individual offices in an office building. The signs are divided into a front plate and a rear plate to facilitate exchange of the information displayed on the sign. This may be done either in that the information is provided on the front plate, which is then exchanged when a new item of information is to be displayed on the sign. Alternatively, the front plate might be made of a transparent material so that a sign material may be interposed between the front plate and the rear plate. In these situations, the front plate is detached from the rear plate, and then a new sign material may be provided.

A sign of the type with the information provided on the front plate is known e.g. from the Danish Published Application No. 154109. The front plate may be pushed over the rear plate and be retained in its correct position by means of a locking mechanism which may be released by means of a magnet. While this solution ensures that the front plate cannot be removed by unauthorized persons, it involves the serious drawback that a special tool, viz. a magnet, has to be used for the information-carrying part to be exchanged.

Further, signs having the front plate hinged to the rear plate are known. Such a sign is known e.g. from the British Patent Application GB 2224152, which describes a sign that may be used e.g. for timetables or the like at a bus stop. The front plate is here hinged to the rear plate by means of pins which can move in a groove on the rear plate. To ensure that unauthorized persons cannot remove the information from this sign, it is necessary to provide the sign with a lock so that it can be opened only by persons who are in possession of the correct key.

Further, from another technical field, containers for e.g. cassette tapes or compact discs are known, where a door is secured at one side to the container by means of hinges and has locking mechanisms at the other side, which can be released by depressing a pawl which secures the door to the container in the locked state.

The object of the invention is to provide a sign structure where the front plate may be detached from the rear plate in a simple and easy manner either for exchange or insertion of sign material between the front plate and the rear plate. Further, it must be capable of being opened without using special tools, preferably merely by using a single hand, and the actual locking mechanism must be invisible from the outside on the closed sign so that unauthorized person cannot readily see how the front plate may be detached from the rear plate.

This is achieved according to the invention in that one of two connecting parts of a connecting means is provided on a member which comprises a partially elastic area, and in that the two connecting parts may be disengaged from each other by acting on the elastic area. With such an elastic area it is easy to release the locking mechanisms by a single hand, since one of the connecting parts may be moved so much as to enable the other to be released merely by pressing on this area with a finger.

An expedient embodiment is obtained when the said element is constructed so as to be capable of rocking about a rocker arrangement, whereby the connecting part at one side of the rocker may be disengaged by depressing the other side of the rocker. The connecting parts may e.g. be formed by a pin and mating hole or a mating recess, respectively.

When the member is provided on the rear plate, a simpler structure of the front plate is obtained, and when the element is formed as an integral part of the outer surface of the rear plate, the member and thus the locking mechanism are practically invisible from the outside when the sign has been assembled.

Making the member itself in one thickness and the elastic area in a smaller thickness results in a configuration which may be manufactured in a simple manner by moulding, and which provides a well-defined elasticity. To protect the locking mechanism against being unintentionally unlocked, the member may moreover be provided with a spring which urges the member toward the position in which the connecting parts are engaged with each other.

A particularly expedient embodiment is obtained when connecting means of the stated type are arranged along two different axes. The connecting means may hereby serve both as a locking mechanism and as hinges. If the means are released along one axis, the means along the other axis serve as hinges about which the front plate may pivot. The user himself may thus choose the side in which the sign is to be opened. Furthermore, the front plate may be removed completely, if the means along both axes are released. The sign device may e.g. be constructed rectangularly with the two axes extending along two of the parallel sides of the sign device.

If the sign device is formed with a transparent front plate, the sign information may be arranged on a sign material which is positioned between the front plate and the rear plate. Then, the front plate does not have to be exchanged when the information is to be exchanged.

Figure 2:
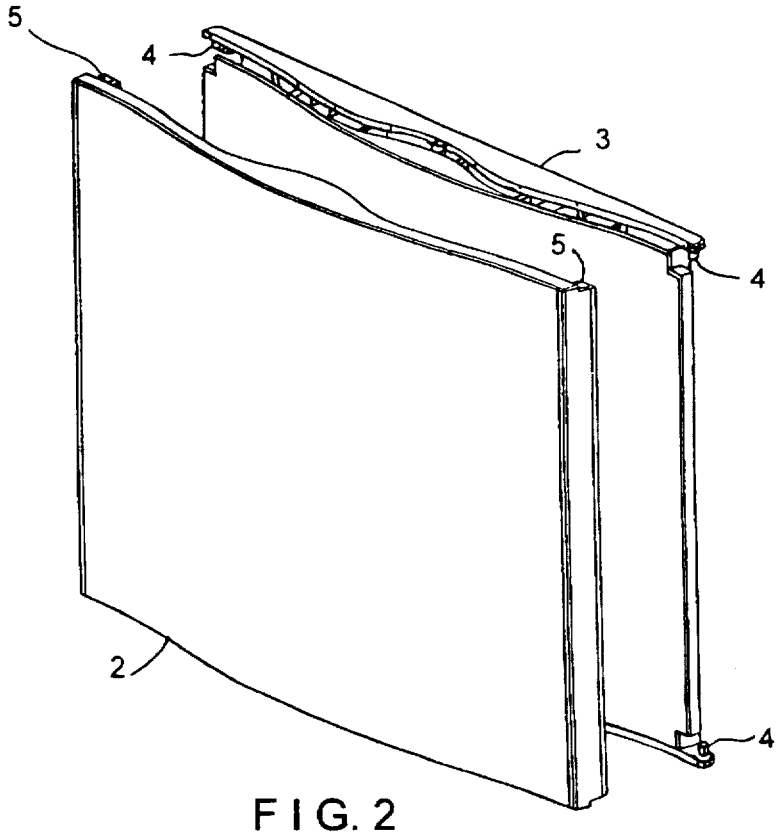
Figure 3:
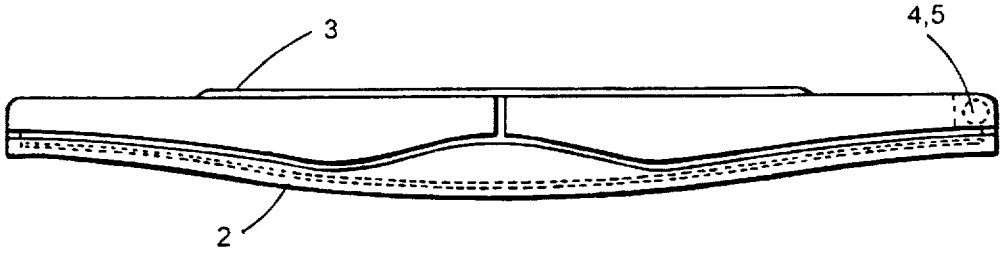
Figure 4:
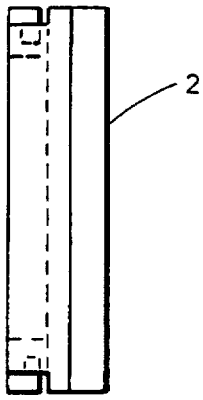
Figure 5:
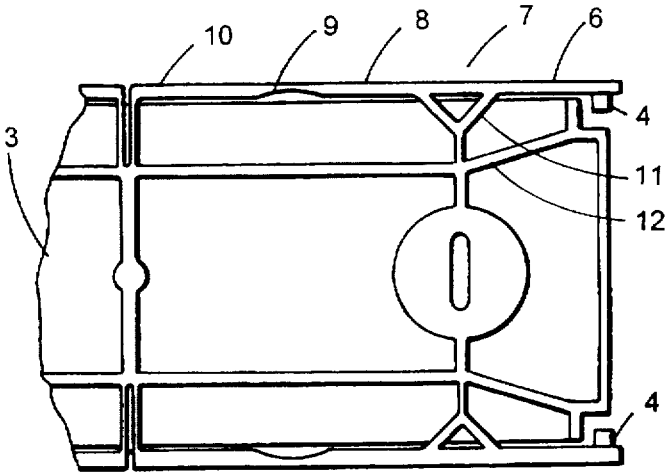
Figure 6:
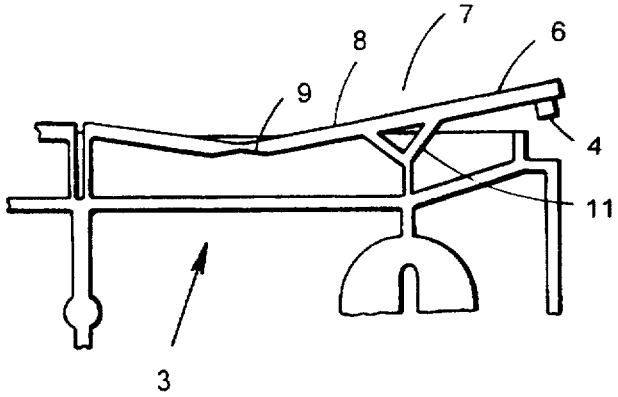
Figure 7:
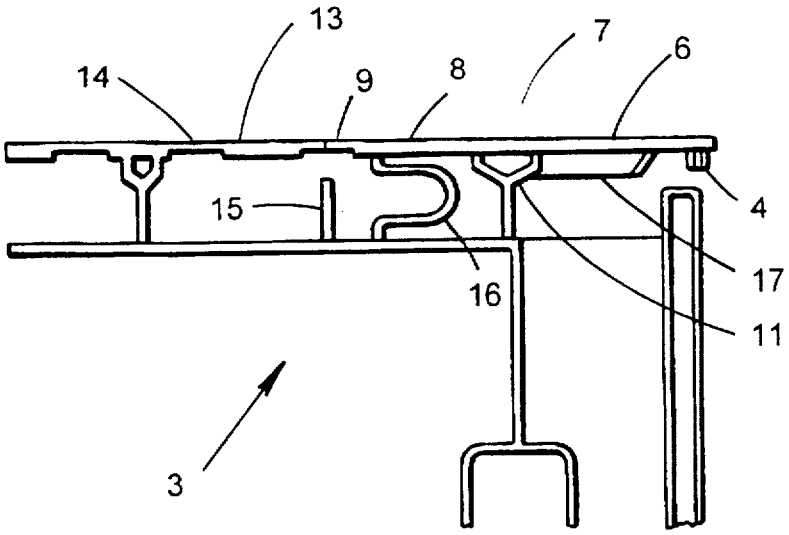
Figure 8:
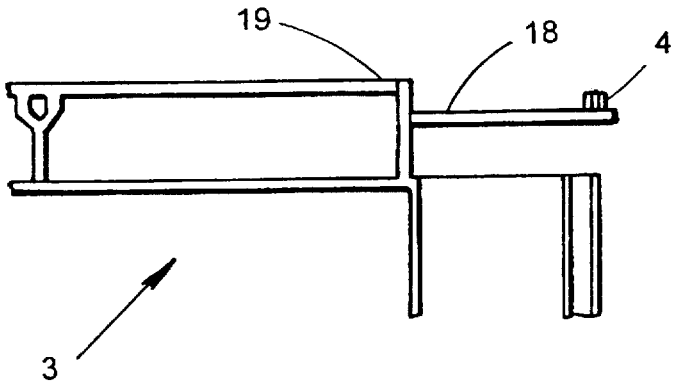

The invention will now be explained more fully by means of an embodiment and with reference to the drawing, in which FIG. 1 shows an example of a sign of the invention, FIG. 2 shows the sign of FIG. 1, with the front plate separated from the rear plate, FIG. 3 is top view of the sign of FIG. 1, FIG. 4 is a lateral view of the sign of FIG. 1, FIG. 5 shows the rear plate of the sign, FIG. 6 is a fragment of FIG. 5 with released connecting means, FIG. 7 shows a fragment of an alternative embodiment of the invention, and FIG. 8 shows a fragment of another alternative embodiment of the invention.

FIGS. 1 to 4 show a sign device 1 of the invention. The sign 1 consists of two main parts, viz. a front plate 2 and a rear plate 3. FIG. 1 shows the sign in its assembled and completed state, while FIG. 2 shows the same sign, but with the front plate 2 separated from the rear plate 3. The front plate 2 may optionally be made of a transparent material, and in that case the information of the sign may be provided on a sign material (not shown) which may be arranged between the front plate 2 and the rear plate 3. It moreover appears from FIG. 2 that the rear plate 3 is provided with pins 4 at its corners, and that the front plate is correspondingly formed with recesses 5 intended to receive the pins 4 on the rear plate 3 when the sign is assembled. Of course, depending upon the thickness of the front plate material 2, the recesses 5 may also be formed as through holes in the material.

FIG. 5 is rear view of a fragment of the rear plate 3, illustrating that each pin 4 is provided on an outer part or first end 6 of a rocker member 7. The inner part or second end 8 of the rocker member 7 is connected with the firm part 10 of the rear plate 3 via a weakening 9. The rocker member 7 is adapted to be capable of rocking about a rocker arrangement or center part 11, which is likewise firmly connected with a firm part 12 of the rear plate material. The situation shown in FIG. 5 corresponds to the normal position of the sign, which means that when the sign has been assembled, the pins 4 are present in the corresponding recesses 5 on the front plate 2.

It is shown in FIG. 6 how the pins 4 may be released from the corresponding recesses in the front plate. The area around the weakening 9 is pushed in here by means of e.g. a finger. The weakening 9 has such a dimension that a suitable force of pressure at this area is sufficient to rock the member 7 about the rocker arrangement 11, thereby causing the outer part 6 and thus the pin 4 to move in a vertical direction in the figure, allowing the front plate 2 to be removed or positioned. The distance from the weakening 9 to the rocker member 11 is likewise such that suitable depression around the area 9 causes the pins 4 to move sufficiently for the front plate to be positioned.

It is noted that the rocker member 7 forms an integral part of the outer side 10 of the rear plate for the sign, which means that, in an assembled sign, the release mechanism is invisible, since it cannot be seen from the outside that a weakening 9 and a rocker arrangement 11 are present. This means that unauthorized persons who do not know the mode of operation of the sign, are not capable of removing the front plate from the rear plate. It is moreover noted that the sign 1 has pins 4 and recesses 5 arranged at both side of the sign. This means that the connecting means, i.e. the pins and the recesses, may serve both as hinges and as locking mechanisms. If e.g. the pins 4 are released from the recesses 5 at the right side of the sign, the front plate may now be pivoted about a vertical axis through the pins 4 and the recesses 5 at the left side of the sign. In this open state it is easy to position or exchange a sign material, following which the sign may easily be closed again. Since the sign is constructed symmetrically, the sign might thus have been opened at the left side instead, and then the pins 4 and the recesses 5 to the right side might serve as hinges. As appears from FIG. 2, the pins may also be released at both sides of the sign of course, whereby the front plate 2 may be removed completely from the rear plate 3. This might be of interest e.g. in the situations where the text of the sign is provided on the front plate itself.

It moreover appears from FIGS. 3 and 5 that the rocker member 7 and the firm part 10 of the outer surface of the rear plate, which part 10 is contiguous with the rocker member, have a varying width. It will thus be seen that the widest area is present around the weakening 9, which means that the sign is easier to operate, since it provides a relatively wide area for the application of pressure to release the mechanism.

FIG. 7 shows a variant of the rear plate 3 corresponding to FIG. 5. The rocker member 7, which consists of the inner part 8 and the outer part 6 on which the pin 4 is provided, fully corresponds to FIG. 5, and also the weakening 9 is included. It will be seen that within the weakening 9 there is a thicker area 13 and then another weakening 14. This means that when the outer side of the sign is depressed around the area 9, flexing will take place partly at the area 9 and partly at the area 14. This means that less force is to be applied for the downward flexing to take place around the area 9. However, to prevent the downward flexing from being too strong, a stop 15 is provided, said stop having a height such that when the area 9 reaches the stop 15, the pin 4 has been moved precisely so much as to allow positioning or removal of a front plate. It is moreover noted that a spring 16 is provided between the inner part 8 of the rocker member 7 and the firm part of the rear plate 3. The spring serves i.a. to ensure that the rocker member 7 returns to its normal state when the pressure is removed from the area 9. The spring 16 has a meander shape ensuring that a suitably low deformation of the material of the spring itself takes place during the spring movement, so that the spring has a long life. Further, a reinforcement 17 is provided below the outer part 6 of the rocker member 7, ensuring that the outer part 6 will be more rigid so that the outer part 6 moves upwards with certainty when depression takes place around the area 9.

Alternatively, the outer surface of the rear plate might be interrupted at the area 9, so that the rocker member 7 was not in direct connection with the rest of the surface. Thus, just the outer part 8 would have to be depressed to release the pin. The spring 16 would then cause the rocker member 7 to return to its normal position when the pressure on the inner part 18 was relieved. However, this would have as a result that the separation at the area 9 would be visible from the outside, thereby revealing where to apply pressure in order to release the mechanism.

FIG. 8 shows an alternative embodiment of the invention. Here the pin 4 is arranged on the upper side of an arm 18 which is connected with the firm part 19 of the rear plate 3. In this situation, the arm 18 must be flexible so that it may be pushed downwards, thereby also moving the pin 4 in a downward direction to release it from the corresponding hole in the front plate 2. Of course, the hole or the recess in the front plate 2 must then be formed such that the pin 4 may be moved into the hole or the recess from below.

The above disclosure includes examples of how a sign device of the invention may be constructed. It will be appreciated that details may be changed in many ways within the scope of the invention. Thus, e.g. the rocker arrangement 11 may be constructed in numerous other ways, and also a sign is conceivable where the described pins and recesses are used only at one side of the sign, while e.g. ordinary hinges are used at the other side of the sign.

I claim:

1. A sign device, comprising:

a rear plate;

a front plate;

at least one means for connecting said rear plate and said front plate, each of said at least one connecting means having a first connecting part on one of said rear plate and said front plate in engagement with a second connecting part on the other of said rear plate and said front plate, said first connecting part being provided on a movable member;

wherein the movable member is a rocker member, said rocker member having a center part, a first end and a second end, said first end and said second end extending from said center part in opposite directions said rocker member being attached to said one of said rear plate and said front plate at said center part, said first connecting part being located in a vicinity of said first end of said rocking member; and wherein said first connecting part is disengageable from said second connecting part by acting on said second end of said rocker member.

2. A sign device according to claim 1, wherein the second end of the rocker member is connected with a firm part of said one of said rear plate and said front plate by a partially elastic area.

3. A sign device according to claim 1 or 2, wherein the first connecting part is formed by a pin and the second connecting part is formed by a mating recess.

4. A sign device according to claim 1 or 3, wherein said rocker member is provided on the rear plate.

5. A sign device according to claim 1 or 2, wherein said rocker member is an integral part of the outer surface of the rear plate.

6. A sign device according to claim 5, wherein the partially elastic area is produced by a weakening in the thickness of the material of the rocker member.

7. A sign device according to claim 1 or 2, wherein said rocker member comprises a spring which urges the rocker member toward the position in which the connecting parts are engaged with each other.

8. A sign device according to claim 1 or 2, wherein the at least one connecting means are arranged along two different axes, so that when the connecting parts along one axis are disengaged from each other, the connecting means along the other axis may serve as hinges about which the front plate may pivot.

9. A sign device according to claim 8, wherein the front plate and the rear plate are rectangular, and wherein the two axes extend along opposite sides of the front plate and the rear plate.

10. A sign device according to claim 1 or 2, wherein at least part of the front plate is transparent, so that sign material may be positioned between the front plate and the rear plate.

* * * * *

UNITED STATES PATENT AND TRADEMARK OFFICE

CERTIFICATE OF CORRECTION

PATENT NO. : 5,778,582
DATED : July 14, 1998
INVENTOR(S) : Klaus Peter Rath

It is certified that error appears in the above-identified patent and that said Letters Patent is hereby corrected as shown below:

On the title page, Item [73], list the address of the Assignee to read as follows:

Billund, Denmark

Signed and Sealed this

Twenty-second Day of September, 1998

*Attest:*

Bruce Lehman

BRUCE LEHMAN

*Attesting Officer*

*Commissioner of Patents and Trademarks*